US008956063B2

(12) United States Patent
Obata et al.

(10) Patent No.: US 8,956,063 B2
(45) Date of Patent: Feb. 17, 2015

(54) IMAGE FORMING APPARATUS

(71) Applicants: Yuuzoh Obata, Tokyo (JP); Kazuyoshi Matsumoto, Tokyo (JP); Norikazu Yanase, Kanagawa (JP); Kazuyoshi Kondo, Tokyo (JP); Makoto Kikura, Kanagawa (JP); Gaku Hosono, Kanagawa (JP); Yoshinori Uchino, Kanagawa (JP)

(72) Inventors: Yuuzoh Obata, Tokyo (JP); Kazuyoshi Matsumoto, Tokyo (JP); Norikazu Yanase, Kanagawa (JP); Kazuyoshi Kondo, Tokyo (JP); Makoto Kikura, Kanagawa (JP); Gaku Hosono, Kanagawa (JP); Yoshinori Uchino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/039,211

(22) Filed: Sep. 27, 2013

(65) Prior Publication Data

US 2014/0099148 A1 Apr. 10, 2014

(30) Foreign Application Priority Data

Oct. 9, 2012 (JP) ..... 2012-224473

(51) Int. Cl.

| | |
|---|---|
| ***B41J 15/16*** | (2006.01) |
| ***B41J 23/12*** | (2006.01) |
| ***B41J 3/407*** | (2006.01) |

(52) U.S. Cl.

CPC ..... *B41J 23/12* (2013.01); *B41J 3/4075* (2013.01); *B41J 15/16* (2013.01)

USPC ..... 400/614; 400/611; 347/104

(58) Field of Classification Search

USPC ..... 400/614

See application file for complete search history.

(56) References Cited

U.S. PATENT DOCUMENTS

| | | | | |
|---|---|---|---|---|
| 3,244,095 | A * | 4/1966 | Matthew | 400/614.1 |
| 3,741,499 | A * | 6/1973 | Osborn | 242/356.7 |
| 2009/0226235 | A1 * | 9/2009 | Kobayashi et al. | 400/614 |
| 2011/0229242 | A1 * | 9/2011 | Morinaga et al. | 400/613 |

FOREIGN PATENT DOCUMENTS

| | | |
|---|---|---|
| JP | 9-274345 | 10/1997 |
| JP | 10-139239 | 5/1998 |

* cited by examiner

*Primary Examiner* — Jill Culler

(74) *Attorney, Agent, or Firm* — Cooper & Dunham LLP

(57) ABSTRACT

An image forming apparatus includes a spool that holds a roll of print medium; an image forming device that forms an image on the medium; a transporting device including a transport rotary member that transports the medium to the image forming device, and a drive source that generates drive force; and a drive force transmission device which transmits the drive force to the spool when the transport rotary member rotates in a medium rewinding direction, and which includes a first gear train for rotating the spool in the same direction as the transport rotary member when the transport rotary member and the spool rotate in the same direction during the transport of the medium and a second gear train for rotating the spool in an opposite direction to the transport rotary member when the transport rotary member and the spool rotate in opposite directions during the medium transport.

5 Claims, 9 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2012-224473, filed on Oct. 9, 2012, in the Japan Patent Office, the entire disclosure of which is hereby incorporated by reference herein.

BACKGROUND

1. Technical Field

The present invention relates to an image forming apparatus, particularly to an image forming apparatus using a rolled print medium.

2. Related Art

An image forming apparatus, such as a label printer, performs printing on a print medium having an adhesive surface with no release liner attached thereto, such as adhesive tape or a label sheet with no backing sheet (hereinafter also referred to as a linerless label sheet), and thereafter cuts the print medium into print medium pieces (hereinafter also referred to as label pieces) of a desired length.

A sheet transporting apparatus or image forming apparatus using a rolled sheet (i.e., a print medium wound in a roll) may include, for example, a spool, a transporting device, and a rotational load device. The spool holds a rolled sheet and is rotatable in both a sheet feeding direction and a sheet rewinding direction. The transporting device transports the sheet through an image forming area. The rotational load device places a predetermined rotational load on the spool. Drive force in the sheet feeding direction is not transmitted to the rotational load device, whereas drive force in the sheet rewinding direction is transmitted to the rotational load device.

If the roll is a bonded roll having a core member bonded to an end portion of the print medium, or if the transporting device and other devices in the apparatus are integrated as a single unit drawable from the body of the apparatus, for example, the print medium transported to the transporting device is rewound into the roll as necessary.

Particularly in the case of a roll of print medium having an exposed adhesive surface, such as a linerless label sheet, if the print medium slackens while being rewound into the roll, parts of the adhesive surface may stick together, or the adhesive surface may stick to another component of the apparatus, preventing the medium rewinding operation. It is therefore desirable to apply tension to the print medium during the medium rewinding operation (also referred to as back tension).

A roll of print medium having an adhesive surface may be a face-out roll wound with the rear surface of the adhesive surface facing outward or a face-in roll wound with the adhesive surface facing outward.

Therefore, if the driving of the transporting device and the rotational driving of the spool holding the roll in a sheet feeding device are performed by a single drive source, and if the rotation direction of the spool is different from the winding direction of the roll, it is difficult to apply the back tension to the print medium during the medium rewinding operation. As a result, parts of the adhesive surface may stick together, or the adhesive surface may stick to another component of the apparatus, as described above.

SUMMARY

It is an object of the present invention to apply back tension to a print medium unwound from a roll, irrespective of the winding direction of the roll.

The present invention provides an improved image forming apparatus that, in one example, includes a spool, an image forming device, a transporting device, and a drive force transmission device. The spool is configured to hold a roll of print medium. The image forming device is configured to form an image on the print medium unwound from the roll. The transporting device includes a transport rotary member and a drive source. The transport rotary member is configured to transport the unwound print medium to the image forming device to face the image forming device. The drive source is configured to generate drive force for driving the transport rotary member to rotate. The drive force transmission device is provided between the transport rotary member and the spool, and is configured to transmit the drive force to the spool when the transport rotary member rotates in a direction of rewinding the print medium into the roll. The drive force transmission device includes a first gear train and a second gear train. The first gear train is configured to form a first transmission path for transmitting the drive force to the spool to rotate the spool in a rotation direction the same as the rotation direction of the transport rotary member, and is selected when the transport rotary member and the spool rotate in the same rotation direction during the transport of the print medium by the transport rotary member. The second gear train is configured to form a second transmission path for transmitting the drive force to the spool to rotate the spool in a rotation direction opposite to the rotation direction of the transport rotary member, and is selected when the transport rotary member and the spool rotate in opposite rotation directions during the transport of the print medium by the transport rotary member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
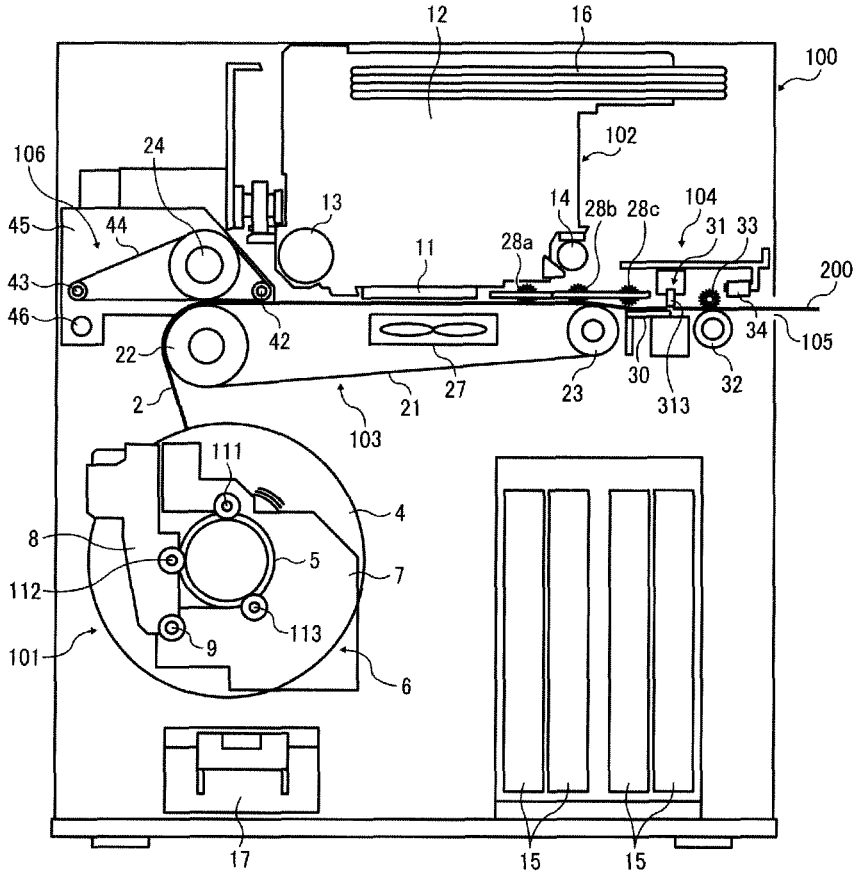
FIG. 1 is a front view of a mechanical section of an image forming apparatus according to a first embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

Figure 2:
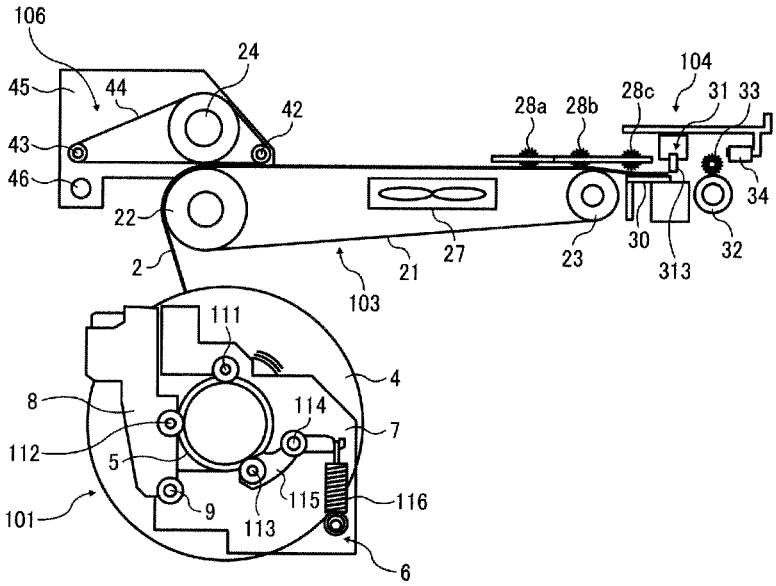
FIG. 2 is a front view of a transporting unit of the mechanical section.
Figure 3:
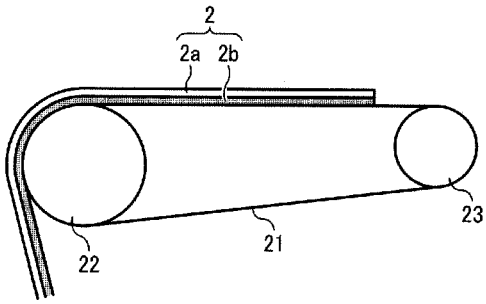
FIG. 3 is a front view of related parts of the transporting unit transporting a print medium.

With reference to FIGS. 1 to 3, an image forming apparatus according to a first embodiment of the present invention will be described. FIG. 1 is a front view of a mechanical section of the image forming apparatus. FIG. 2 is a front view of a transporting unit of the mechanical section. FIG. 3 is a front view of related parts of the transporting unit transporting a print medium.

The image forming apparatus includes an apparatus body 100 including a sheet feeding unit 101 (i.e., a sheet feeding device), an image forming unit 102 (i.e., an image forming device), a transporting unit 103 (i.e., a transporting device), a sheet discharging unit 104 (i.e., a sheet discharging device), a guiding device 106, ink cartridges 15, a waste liquid tank 17, and a discharge opening 105. The guiding device 106 guides a print medium 2 (also referred to as a recording medium or a sheet) during transport or rewinding of the print medium 2.

The print medium 2 is wound in a roll 4, which is installed in the sheet feeding unit 101. As illustrated in FIG. 3, in the present embodiment, the print medium 2 is a continuum of image-formable media having a surface formed with an adhesive layer. Hereinafter, the image-formable medium and the adhesive layer will be referred to as the printing surface 2*a* and the adhesive surface 2*b*, respectively. Specifically, the print medium 2 is a rolled linerless label sheet with no backing sheet (i.e., release liner or separator) attached to the adhesive surface 2*b*.

The sheet feeding unit 101 includes the roll 4, a spool 5, and two roll holders 6. FIGS. 1 and 2 illustrate one of the two roll holders 6, i.e., the roll holder 6 on the front side of the apparatus body 100. As illustrated in FIG. 2, each of the roll holders 6 includes a spool bearing 7, an openably closable member 8, a first roller 111, a second roller 112, a third roller 113 (i.e., first to third rotary members), a shaft 9, a shaft 114, a roller holder 115, and a spring 116.

The roll 4 is fitted around the spool 5. The spool 5 has opposed end portions rotatably held at three points by the first roller 111, the second roller 112, and the third roller 113 provided in each of the roll holders 6.

In the present specification, the term "spool" is not limited to a member provided separately from a core member of the roll 4, and may also refer to a member formed integrally with the core member of the roll 4 and configured to be held by the roll holders 6. If the core member of the roll 4 is directly held by the roll holders 6, such a core member serves as a spool.

In the present embodiment, the first roller 111 is rotatably held by the spool hearing 7, which receives the corresponding one of the end portions of the spool 5 fitted therein, and the second roller 112 is rotatably held by the openably closable member 8, which is configured to open and close relative to the spool bearing 7. Further, the third roller 113 is rotatably held by the roller holder 115. The roller holder 115 is rotatably held by the shaft 114 and biased by the spring 116 to press the third roller 113 against the spool 5.

The image forming unit 102 includes a carriage 12, two recording heads 11, a main guide member 13, a sub-guide member 14, and supply tubes 16. The recording heads 11, which are liquid ejection heads that eject liquid droplets onto the print medium 2, are mounted on the carriage 12. The carriage 12 is movably held by the main guide member 13 and the sub-guide member 14 to move from side to side in a main scanning direction substantially perpendicular to the direction of transporting the print medium 2 (hereinafter referred to as the medium transporting direction).

The present embodiment uses, as the recording heads 11, two liquid ejection heads each including two nozzle rows (not illustrated) to eject ink droplets of black, cyan, magenta, and yellow colors from four nozzle rows. The recording heads 11, however, are not limited thereto, and may be line heads. Inks of the respective colors are supplied as necessary from the ink cartridges 15 replaceably installed in the apparatus body 100 to head tanks (not illustrated) of the carriage 12 through the supply tubes 16, and then to the recording heads 11. Waste ink resulting from, for example, a maintenance operation for maintaining and restoring the performance of the recording heads 11 is discharged to and stored in the waste liquid tank 17 replaceably installed in the apparatus body 100. In the image forming unit 102, the form of the recording heads 11 (i.e., liquid ejection heads) is not limited, as described above. Further, various types of image forming devices that form an image on a print medium in a contact or non-contact manner are applicable to the image forming unit 102.

Figure 6:
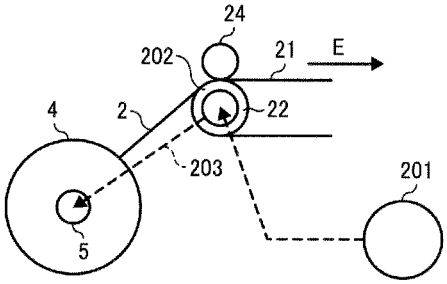
FIG. 6 is a schematic diagram illustrating a drive force transmission system according to the first embodiment provided between a drive source and a spool.

The transporting unit 103 includes an endless protective belt 21, a transport roller 22 (i.e., a transport rotary member), a driven roller 23, a facing roller 24, a suction fan 27, spur roller groups 28*a*, 28*b*, and 28*c*, and a drive motor 201 (i.e., a drive source) illustrated in FIG. 6. The protective belt 21 serving as a transport belt is disposed below the recording heads 11, and is rotatably stretched taut around the transport roller 22 and the driven roller 23. Preferably, the protective belt 21 is not adhesive to the adhesive surface 2*b* of the print medium 2. The protective belt 21, however, may have weak adhesiveness to the adhesive surface 2*b* of the print medium 2 to prevent the print medium 2 from separating from the protective belt 21 during the transport of the print medium 2 (hereinafter referred to as the medium transporting operation) and separate from the print medium 2 after the medium transporting operation. Received by the protective belt 21, the adhesive surface 2*b* of the print medium 2 is protected and prevented from coming into contact with other components inside the apparatus body 100. Thereby, stable transport performance is obtained. Further, due to the separability of the protective belt 21 from the adhesive surface 2*b* of the print medium 2, the print medium 2 is reliably sent to the next process. That is, the protective belt 21 of the present embodiment functions as a transport belt and also as a protector of the adhesive surface 2*b* of the print medium 2.

The facing roller 24 is disposed facing the transport roller 22. The transport roller 22 and the facing roller 24 form a transport roller pair a rotary member pair) serving as a transporting device that clamps and transports the print medium 2 and the protective belt 21 to an image forming area in which an image is formed by the recording heads 11. The protective belt 21 is formed with a multitude of suction holes. Inside a loop of the protective belt 21, the suction fan 27 is disposed facing the recording heads 11 of the image forming unit 102 via the protective belt 21. The suction fan 27 sucks the print medium 2 toward the outer circumferential surface of the protective belt 21 through the suction holes.

It is to be noted that the transporting unit 103 of the present embodiment is configured to attract the print medium 2 toward the protective belt 21 by suction. However, the configuration is not limited thereto. For example, the transporting unit 103 may be configured to attract the print medium 2 with electrostatic force. Alternatively, the print medium 2 may be kept in contact with the protective belt 21 not to separate therefrom by the adhesiveness of the adhesive surface 2*b* of the print medium 2.

Near the driven roller 23, the spur roller groups 28*a*, 28*b*, and 28*c* are disposed each of which includes a plurality of spur rollers aligned in a direction substantially perpendicular to the medium transporting direction. The spur roller groups 28*a* and 28*b* located on the upstream side in the medium transporting direction face the protective belt 21, and the most downstream spur roller group 28*c* faces a receiving member 30 of the sheet discharging unit 104.

The sheet discharging unit 104 includes a receiving member 30, a cutter unit 31, a discharge roller 32, a spur roller group 33, and a sheet sensor 34. The receiving member 30 guides the print medium 2 sent thereto from between the protective belt 21 and the spur roller group 28*b*. The cutter unit 31 disposed downstream of the receiving member 30 in the medium transporting direction serves as a cutting device that cuts the print medium 2 into print medium pieces, i.e., label pieces 200 of a desired length. The cutter unit 31 includes an upper cutter 313 and a lower cutter formed by a downstream end surface of the receiving member 30 receiving the print medium 2. The upper cutter 313 moves in a direction substantially perpendicular to the medium transporting direction to cut the print medium 2 in conjunction with the lower cutter.

The discharge roller 32 is disposed downstream of the cutter unit 31 in the medium transporting direction to face the spur roller group 33 including a plurality of spur rollers aligned in a direction substantially perpendicular to the medium transporting direction. The discharge roller 32 and the spur roller group 33 hold the label piece 200 cut by the cutter unit 31, with a leading end portion of the label piece 200 discharged to the discharge opening 105 of the apparatus body 100. In the present embodiment, the outer circumferential surface of the discharge roller 32 for holding the label piece 200 is treated, for example, with an anti-adhesive for preventing the adhesive surface 2*b* of the label piece 200 from adhering to the surface of the discharge roller 32, to thereby make the adhesive surface 2*b* of the label piece 200 separable from the surface of the discharge roller 32. In this case, the discharge roller 32 as a whole may be made of a material separable from the adhesive surface 2*b*. The sheet sensor 34 detects the presence or absence of the print medium 2. The sheet sensor 34 may be a photosensor or a combination of a mechanical lever and a photosensor, for example.

In the present embodiment, the guiding device 106 is constructed of the facing roller 24, a second roller 42, a third roller 43, an endless guide belt 44, a holder 45, and a shaft 46. The facing roller 24, which serves as a component of the transporting unit 103, as described above, also serves as a component of the guiding device 106. The second roller 42 serving as a separation roller is disposed downstream of the facing roller 24 serving as a first roller and upstream of the image forming unit 102 in the medium transporting direction. The third roller 43 is disposed on the opposite side of the second roller 42 across the facing roller 24. The guide belt 44 is stretched around the facing roller 24, the second roller 42, and the third roller 43. In the present embodiment, the guide belt 44 is a belt member including a base material made of polyimide and an outer circumferential surface formed with a release layer (e.g., a silicone coating) on the base material to improve the releasability of the guide belt 44 from the adhesive surface 2*b* of the print medium 2.

The facing roller 24, the second roller 42, and the third roller 43 are rotatably held by the holder 45. The holder 45 is disposed to be rotatable about the shaft 46 to allow the facing roller 24 to move between a position at which the facing roller 24 faces the transport roller 22 and a position at which the facing roller 24 is separated from the transport roller 22 to provide a space between the facing roller 24 and the transport roller 22. To install the roll 4 in the sheet feeding unit 101 and set the print medium 2 on the protective belt 21, the space between the facing roller 24 and the transport roller 22 is opened. To transport the print medium 2, the facing roller 24 is pressed against the transport roller 22. Therefore, the facing roller 24 is pressed against the transport roller 22 by a pressing device such as a spring. Similarly, the second roller 42 is also pressed against the protective belt 21 by a pressing device such as a spring.

As described above, the present embodiment is configured to perform image formation on the print medium 2 with the adhesive surface 2*b* facing the protective belt 21. Alternatively, the image formation may be performed on the adhesive surface 2*b* of the print medium 2. In this case, it is preferable that the outer circumferential surface of the guide belt 44 is treated with an anti-adhesive for preventing the adhesive surface 2*b* of the print medium 2 from adhering to the surface of the guide belt 44.

In the thus-configured image forming apparatus, the protective belt 21 and the print medium 2 unwound from the roll 4 installed in the sheet feeding unit 101 are set between the transport roller 22 and the facing roller 24. Then, the transport roller 22 is driven to rotate to transport the print medium 2 with the adhesive surface 2*b* protected by the protective belt 21, and a desired image is formed on the print medium 2 by the recording heads 11 of the image forming unit 102. The print medium 2 having the image formed thereon is then separated from the protective belt 21 and sent to the sheet discharging unit 104 to be cut into the label piece 200 at a predetermined position by the cutter unit 31. Thereby, the label piece 200 is held between the discharge roller 32 and the spur roller group 33 to be dischargeable from the discharge opening 105 of the apparatus body 100.

Particularly in a case in which the image is formed on the adhesive surface 2*b* of the print medium 2, the guiding device 106 prevents the print medium 2 from being caught in the facing roller 24 during the transport or rewinding of the print medium 2. Without the guide belt 44, the adhesive surface 2*b* of the print medium 2 may stick to and be caught in the outer circumferential surface of the facing roller 24 due to a relatively small curvature of the facing roller 24, even if the outer circumferential surface of the facing roller 24 is treated with an anti-adhesive. In this case, the curvature of the facing roller 24 may be increased to prevent such a transport failure. The increase in curvature of the facing roller 24, however, reduces the area of a clamp region between the facing roller 24 and the transport roller 22, making it difficult to obtain stable transport performance.

In the present embodiment, therefore, the print medium 2 in the medium transporting operation is transported while being held by the guide belt 44, and is reliably separated from the guide belt 44 by the second roller 42 with a relatively large curvature serving as a separation roller. Thereby, the print medium 2 is prevented from being caught in the facing roller 24 in the medium transporting operation. Also in the rewinding of the print medium 2 (hereinafter referred to as the medium rewinding operation), the guide belt 44 receives the adhesive surface 2*b* of the print medium 2 to prevent the print medium 2 from being caught in the facing roller 24.

After the image formation and the cutting of the print medium 2 by the cutter unit 31, a leading end portion of the print medium 2 is located at the position of the cutter unit 31. If the next image forming operation starts in this state, a portion of the print medium 2 facing the image forming unit 102 will be wasted without being used (i.e., with no image formed thereon). To prevent this, the print medium 2 is rewound in a rewinding direction opposite to the medium transporting direction to a position at which the leading end portion of the print medium 2 is located before (i.e., upstream of) the image forming unit 102 in the medium transporting direction.

Figure 4A:
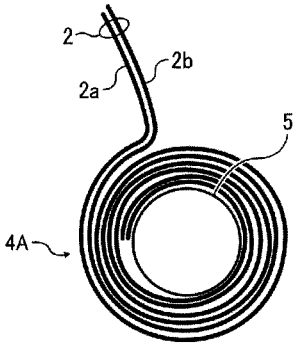
FIGS. 4A and 4B are schematic diagrams illustrating winding directions of rolls.
Figure 4B:
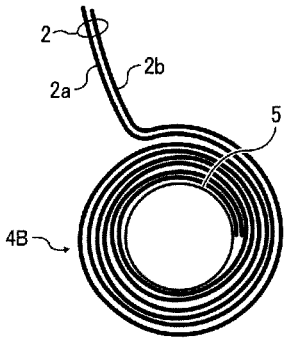

Schematic diagrams of FIGS. 4A and 4B illustrate winding directions of rolls 4A and 4B. The roll 4A illustrated in FIG. 4A is a face-out roll wound with the printing surface 2*a* facing outward, and the roll 4B illustrated in FIG. 4B is a face-in roll wound with the adhesive surface 2*b* facing outward.

Figure 5A:
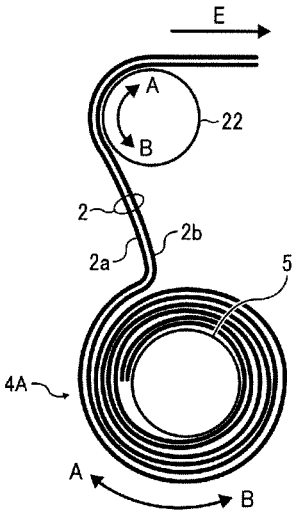
FIGS. 5A and 5B are schematic diagrams illustrating rotation directions of the rolls during transport and rewinding of the print medium.
Figure 5B:
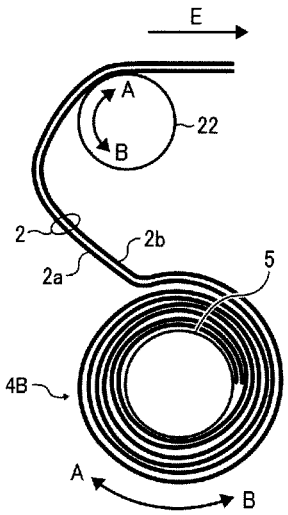

With reference to schematic diagrams of FIGS. 5A and 5B, rotation directions of the rolls 4A and 4B during transport and rewinding of the print medium 2 will now be described. In FIGS. 5A and 5B, the rolls 4A and 4B and the transport roller 22 are illustrated, and the illustration of other components such as the protective belt 21 and the facing roller 24 is omitted. In the drawings, the direction indicated by arrow E corresponds to the medium transporting direction.

In the present embodiment, the rotation of the transport roller 22 is transmitted to the spool 5 via a unidirectional clutch 202 illustrated in FIG. 6, as described later. When the transport roller 22 rotates in the direction of transporting the print medium 2, the unidirectional clutch 202 does not transmit the rotation of the transport roller 22 to the spool 5. When the transport roller 22 rotates in the direction of rewinding the print medium 2, the unidirectional clutch 202 transmits the rotation of the transport roller 22 to the spool 5.

For example, therefore, when the print medium 2 unwound from the face-out roll 4A is transported by the transport roller 22 to form an image on the printing surface 2*a* of the print medium 2, as described above, the face-out roll 4A and the transport roller 22 both rotate in rotation direction A (i.e., clockwise direction), as illustrated in FIG. 5A. Meanwhile, the face-in roll 4B rotates in rotation direction B (i.e., counterclockwise direction) opposite to rotation direction A, in which the transport roller 22 rotates, as illustrated in FIG. 5B.

When the print medium 2 is rewound into the face-out roll 4A, therefore, the spool 5 is rotated in rotation direction B, in which the transport roller 22 is rotated, as illustrated in FIG. 5A. In this case, if the transport roller 22 and the spool 5 are set to different rotation velocities to cause a velocity difference therebetween, the back tension is applied to the print medium 2 being rewound. Meanwhile, in the case of the face-in roll 4B, if the spool 5 is rotated in rotation direction B, in which the transport roller 22 is rotated, the print medium 2 being rewound slackens, as illustrated in FIG. 5B. As a result, parts of the adhesive surface 2*b* may stick together, or the adhesive surface 2*b* may stick to another component inside the apparatus body 100, preventing the medium rewinding operation.

In this case, if the transport roller 22 and the spool 5 are driven by different drive sources, it is possible to rotate the roll 4 in the appropriate rotation direction, whether the roll 4 is the face-out roller 4A or the face-in roller 4B. The use of an additional drive source for the spool 5 to perform the medium rewinding operation and control the rotation direction, however, complicates the configuration.

Therefore, the present embodiment is configured to change the rotation direction of the spool 5 while driving the transport roller 22 and the spool 5 by using a single drive source. Accordingly, the present embodiment is capable of rewinding the print medium 2 while applying appropriate back tension thereto, whether the roll 4 is the face-out roller 4A or the face-in roller 4B.

Figure 7A:
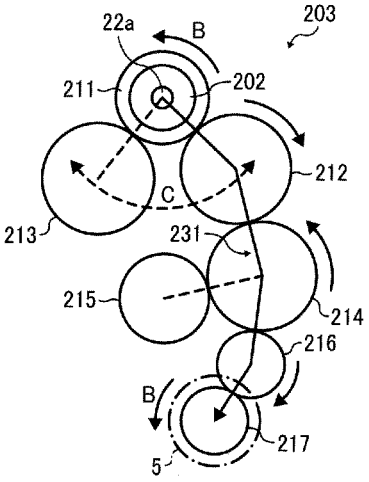
FIGS. 7A and 7B are diagrams illustrating a drive force transmission device of the drive force transmission system provided between a transport roller and the spool.
Figure 7B:
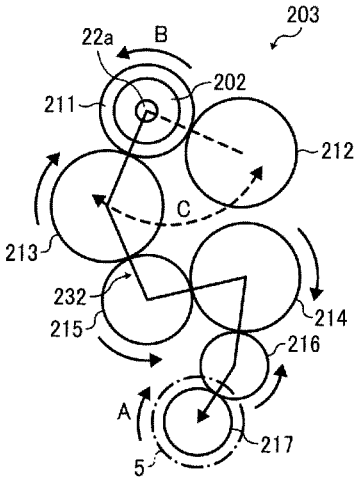

With reference to FIG. 6 and FIGS. 7A and 7B, a drive force transmission system according to the first embodiment will now be described. FIG. 6 is a schematic diagram illustrating the drive force transmission system according to the first embodiment provided between the drive motor 201 and the spool 5. FIGS. 7A and 7B are diagrams illustrating a drive force transmission device 203 of the drive force transmission system provided between the transport roller 22 and the spool 5. FIG. 7A illustrates a first transmission path 231, and FIG. 7B illustrates a second transmission path 232.

The drive force transmission system according to the present embodiment includes a unidirectional clutch 202 and the drive force transmission device 203 including gears 211 to 217. The transport roller 22 is driven to rotate by the drive motor 201 serving as a drive source. Drive force for rotating the transport roller 22 in the direction of rewinding the print medium 2 is transmitted to the drive force transmission device 203 via the unidirectional clutch 202, and then to the spool 5. Thereby, the spool 5 having the roll 4 fitted therearound is rotated.

When the circumferential velocity of the roll 4 and the circumferential velocity of transport roller 22 are represented as VA and VB, respectively, the present embodiment is configured to have a reduction ratio causing a velocity difference between the circumferential velocities VA and VB satisfying a relationship VA≥VB during the rewinding of the print medium 2 into the roll 4, to thereby apply the back tension to the print medium 2 in a region between the transport roller 22 and the roll 4.

In the drive force transmission device 203, the gear 211 is attached to a shaft 22*a* of the transport roller 22 via the unidirectional clutch 202. The gear 211 is in mesh with the gears 212 and 213 configured to be displaceable (i.e., rotatable) about the shaft 22*a* of the transport roller 22 in the direction indicated by arrow C. Further, the gear 214 is configured to mesh with the gear 212. The gear 215 in mesh with the gear 214 is configured to mesh with the gear 213. The gear 216 is in mesh with the gear 214 and the gear 217 provided to the spool 5. In the present example, the drive force transmission device 203 is comprised of gear trains. The configuration of the drive force transmission device 203, however, is not limited to gear trains, and may also include a timing belt, for example.

As illustrated in FIG. 7A, in the thus-configured drive force transmission device 203, the gear 212 is caused to mesh with the gear 214 in accordance with switching between the gears 212 and 213, thereby forming the first transmission path 231 that extends from the gear 211 connected to the unidirectional clutch 202 to the gear 217 connected to the spool 5 via the gears 212, 214, and 216. That is, the first transmission path 231 is formed by the gears 211, 212, 214, 216, and 217 serving as a first gear train. Further, as illustrated in FIG. 7B, the gear 213 is caused to mesh with the gear 215 in accordance with switching between the gears 212 and 213, thereby forming the second transmission path 232 that extends from the gear 211 connected to the unidirectional clutch 202 to the gear 217 connected to the spool 5 via the gears 213, 215, 214, and 216. That is, the second transmission path 232 is formed by the gears 211, 213, 215, 214, 216, and 217 serving as a second gear train.

If the transport roller 22 and the spool 5 rotate in the same rotation direction during the transport of the print medium 2 by the transport roller 22, i.e., if the transport roller 22 and the spool 5 both rotate in rotation direction A during the medium transporting operation, as illustrated in FIG. 5A, the roll 4 corresponds to the face-out roll 4A. In the medium rewinding operation, therefore, the first transmission path 231 is selected. Thereby, the transport roller 22 and the spool 5 both rotate in rotation direction B. Further, the circumferential velocity of the roll 4 and the circumferential velocity of the transport roller 22 are set to cause the above-described velocity difference. Accordingly, back tension is applied to the print medium 2 being rewound, preventing the print medium 2 from slackening.

If the transport roller 22 and the spool 5 rotate in opposite rotation directions during the transport of the print medium 2 by the transport roller 22, i.e., if the transport roller 22 rotates in rotation direction A and the spool 5 rotates in rotation direction B during the medium transporting operation, as illustrated in FIG. 5B, the roll 4 corresponds to the face-in roll 4B. In the medium rewinding operation, therefore, the second transmission path 232 is selected. Thereby, the transport roller 22 rotates in rotation direction B, and the spool 5 rotates in rotation direction A. Further, the circumferential velocity of the roll 4 and the circumferential velocity of transport roller 22 are set to cause the above-described velocity difference. Accordingly, back tension is applied to the print medium 2 being rewound, preventing the print medium 2 from slackening.

In a case in which the image formation is performed on the adhesive surface 2*b* of the print medium 2, the roll 4 is installed in a reverse manner to that in the case in which the image formation is performed on the printing surface 2*a* of the print medium 2. That is, in the case of the face-out roll 4A, the face-out roll 4A is installed such that the print medium 2 is unwound in the unwinding direction illustrated in FIG. 5B. In the case of the face-in roll 4B, the face-in roll 413 is installed such that the print medium 2 is unwound in the unwinding direction illustrated in FIG. 5A. Accordingly, the selection between the first transmission path 231 and the second transmission path 232 is reverse to that in the above-described embodiment.

As described above, the present embodiment is configured to include the first transmission path 231 for rotating the spool 5 in the same direction as that of the transport roller 22 and the second transmission path 232 for rotating the spool 5 in the opposite direction to that of the transport roller 22. Further, the present embodiment is configured to switch to the first transmission path 231 when the transport roller 22 and the spool 5 rotate in the same rotation direction during the transport of the print medium 2 by the transporting unit 103, and switch to the second transmission path 232 when the transport roller 22 and the spool 5 rotate in opposite rotation directions during the transport of the print medium 2 by the transporting unit 103. Accordingly, back tension is applied to the print medium 2 during the medium rewinding operation irrespective of the winding direction of the roll 4. Particularly in the case of the rolled print medium 2 with the exposed adhesive surface 2*b*, such as a linerless label sheet, the present embodiment prevents parts of the adhesive surface 2*b* from sticking together and prevents the adhesive surface 2*b* from sticking to another component during the medium rewinding operation, thereby obtaining stable rewinding performance.

Figure 8A:
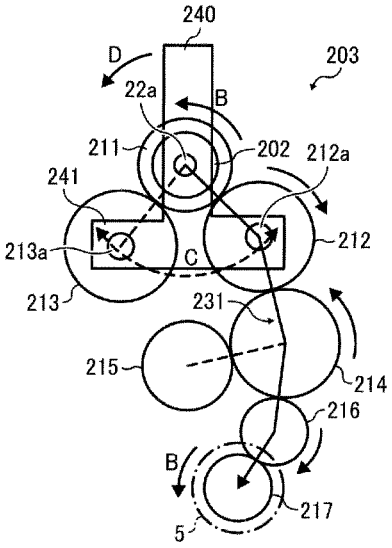
FIGS. 8A and 8B are schematic diagrams illustrating a drive force transmission device according to a second embodiment of the present invention.
Figure 8B:
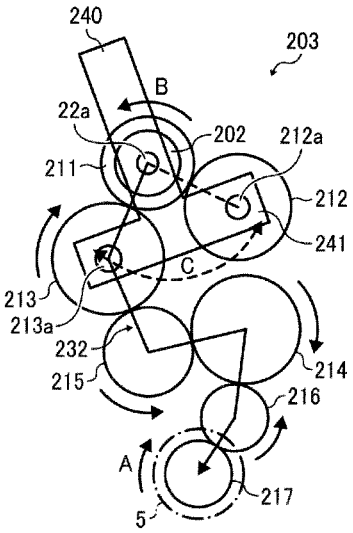

With reference to schematic diagrams of FIGS. 8A and 8B, a second embodiment of the present invention will now be described. The second embodiment allows the above-described operation of switching between the gears 212 and 213 in the first embodiment to be manually performed. That is, the second embodiment includes a lever 240 (i.e., a switching device) rotatably provided to the shaft 22*a* of the transport roller 22. The lever 240 includes a gear holder 241 having opposed end portions rotatably holding a shaft 212*a* of the gear 212 and a shaft 213*a* of the gear 213. If the lever 240 is rotated to cause the gear 212 to mesh with the gear 214, as illustrated in FIG. 8A, the first transmission path 231 is selected. If the lever 240 in this state is rotated in the direction indicated by arrow D to cause the gear 213 to mesh with the gear 215, as illustrated in FIG. 8B, the second transmission path 232 is selected.

Figure 9:
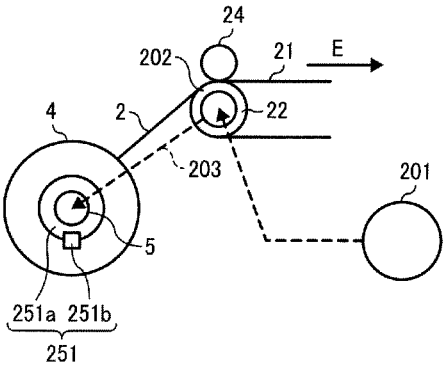
FIG. 9 is a schematic diagram illustrating a drive force transmission system according to a third embodiment of the present invention.

With reference to a schematic diagram of FIG. 9, a third embodiment of the present invention will now be described. The third embodiment includes a rotary encoder 251 provided to a shaft of the spool 5. The rotary encoder 251 serves as a rotation direction detector that detects the rotation direction of the spool 5 during the medium transporting operation. The rotary encoder 251 includes an encoder wheel 251*a* and an encoder sensor 251*b*. The encoder wheel 251*a* is provided to the spool 5 and includes a slit. The encoder sensor 251*b* reads the slit of the encoder wheel 251*a*.

With this configuration, when the transport roller 22 is driven to rotate and transports the print medium 2, the rotation direction of the spool 5 is detected from the detection result obtained by the rotary encoder 251. That is, whether the transport roller 22 and the spool 5 rotate in the same rotation direction or in opposite rotation directions is detected. The rotation direction of the transport roller 22 during the medium transporting operation is predetermined. Further, the transport roller 22 is also provided with a rotary encoder (not illustrated) for controlling the medium transporting operation. Therefore, the rotation direction may be detected from the detection result obtained by the rotary encoder provided to the transport roller 22.

Accordingly, the third embodiment is capable of determining, for example, whether the installed roll 4 corresponds to the face-out roll 4A or the face-in roll 4B. Therefore, the third embodiment may be configured to include, for example, the lever 240 according to the second embodiment and an actuator for actuating the lever 240 to perform the medium rewinding operation by switching between the first transmission path 231 and the second transmission path 232 in accordance with the determination result. In the present embodiment, the rotary encoder 251 serving as a rotation direction detector is provided to the spool 5. The rotary encoder 251, however, may be provided to another member that rotates in accordance with the rotation of the transport roller 22 in the medium transporting direction.

Figure 10:
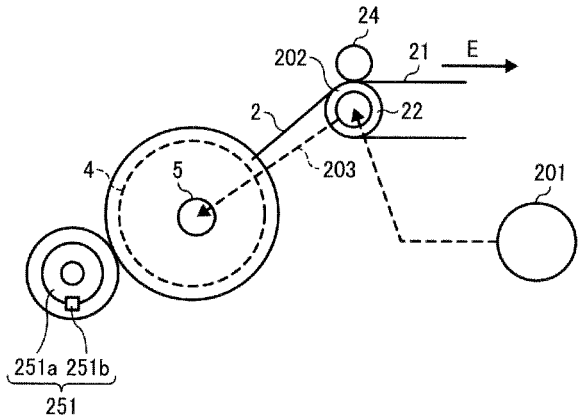
FIG. 10 is a schematic diagram illustrating a drive force transmission system according to a fourth embodiment of the present invention.
Figure 11:
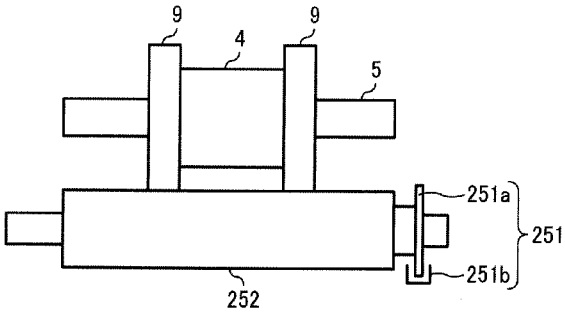
FIG. 11 is a diagram illustrating the layout of a rotation direction detector according to the fourth embodiment.

With reference to FIGS. 10 and 11, a fourth embodiment of the present invention will now be described. FIG. 10 is a schematic diagram illustrating a drive force transmission system according to the fourth embodiment. FIG. 11 is a diagram illustrating the layout of the rotary encoder 251 according to the fourth embodiment.

The fourth embodiment includes flanges 9 and a rotary member 252, as illustrated in FIG. 11. The rotary member 252 rotates with the rotation of the spool 5, and is provided with the above-described rotary encoder 251 serving as a rotation direction detector. Specifically, as illustrated in FIG. 11, the rotary member 252 rotates in accordance with the rotation of the flanges 9 holding opposed end portions in the axial direction of the roll 4 that rotates together with the spool 5, and the rotation of the rotary member 252 is detected by the rotary encoder 251.

When the transport roller 22 is driven to rotate and transports the print medium 2, therefore, the thus-configured fourth embodiment is capable of detecting the rotation direction of the spool 5 from the detection result obtained by the rotary encoder 251, similarly as in the third embodiment. Further, the fourth embodiment allows the rotary member 252 and the rotary encoder 251 to be provided to the apparatus body 100. This configuration prevents the rotary encoder 251 from being damaged compared with the configuration in which the rotary encoder 251 is provided to the spool 5, which is removed in the replacement of the roll 4.

With reference to the flowcharts of FIGS. 12 and 13, description will now be given of an example of transmission path switching performed in embodiments of the present invention including the above-described rotary encoder 251.

Figure 12:
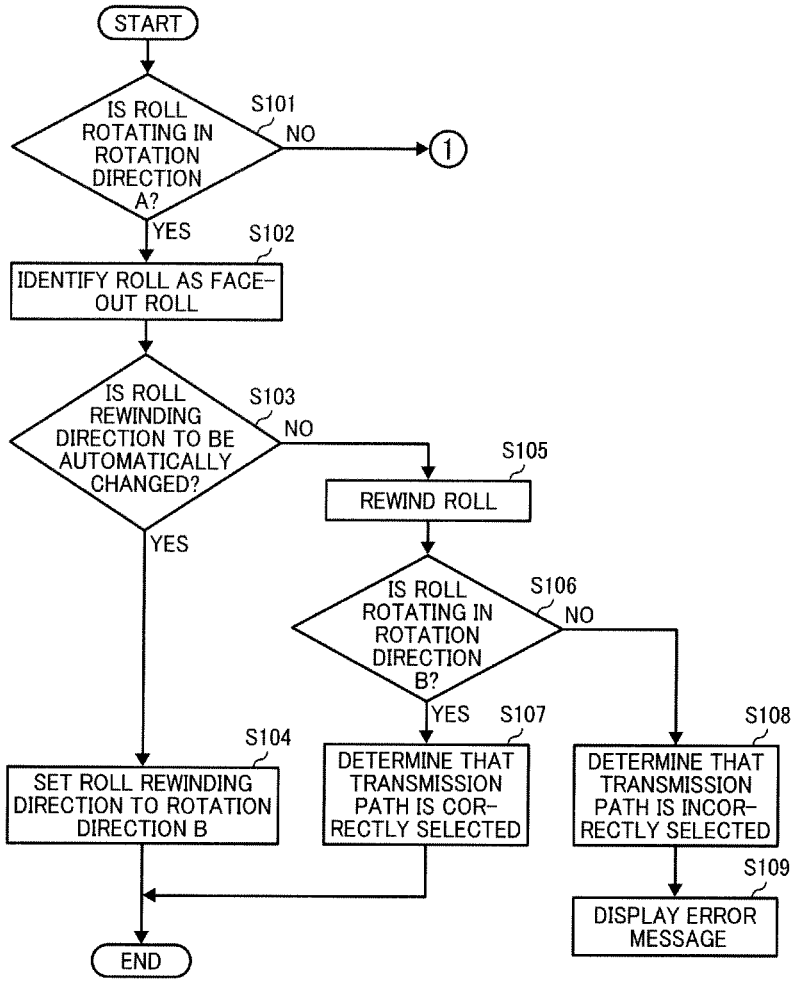
FIG. 12 is a flowchart illustrating an example of transmission path switching performed in an embodiment of the present invention including the rotation direction detector.

In FIG. 12, the transport roller 22 is rotated in rotation direction A to start transporting the print medium 2. Then, whether or not the roll 4 is rotating in rotation direction A is determined from the detection result obtained by the rotary encoder 251 (step S101). If the roll 4 is rotating in rotation direction A (YES at step S101), the roll 4 is identified as the face-out roll 4A (step S102), and the procedure proceeds to step S103 and subsequent steps illustrated in FIG. 12. If the roll 4 is rotating in rotation direction B (NO at step S101), the roll 4 is identified as the face-in roll 4B (step S202 in FIG. 13), and the procedure proceeds to step S203 and subsequent steps illustrated in FIG. 13.

If the apparatus body 100 includes a device that automatically changes the rewinding direction of the roll 4 (hereinafter referred to as the roll rewinding direction), the roll rewinding direction is set in accordance with the winding direction of the identified roll 4. Specifically, as illustrated in FIG. 12, if the roll 4 is rotating in rotation direction A and identified as the face-out roll 4A (step S102), and if the initially set roll rewinding direction is different from the roll rewinding direction to be set, the initially set roll rewinding direction is automatically changed (YES at step S103), and the roll rewinding direction is set to rotation direction B (step S104). Further, as illustrated in FIG. 13, if the roll 4 is rotating in rotation direction B and identified as the face-in roll 4B (step S202), and if the initially set roll rewinding direction is different from the roll rewinding direction to be set, the initially set roll rewinding direction is automatically changed (YES at step S203), and the roll rewinding direction is set to rotation direction A (step S204).

If the installed roll 4 corresponds to the face-out roll 4A, and if the roll rewinding direction is to be manually changed (NO at step S103), the drive motor 201 is driven to rotate the transport roller 22 in rotation direction B and rewind the print medium 2 into the roll 4 (step S105), as illustrated in FIG. 12. Then, whether or not the roll 4 is rotating in rotation direction B is determined from the detection result obtained by the rotary encoder 251 (step S106). In this rewinding operation, the roll 4 is rotated by a minimum amount enough to allow the identification of the rotation direction. If the roll 4 is rotating in rotation direction B (YES at step S106), it is determined that the transmission path for transmitting the drive force is correctly selected (step S107), and the present procedure as a preparation for printing is completed. If the roll 4 is rotating in rotation direction A (NO at step S106), it is determined that the transmission path for transmitting the drive force is incorrectly selected (step S108), and an error message is displayed to prompt changing of the roll rewinding direction (step S109).

Figure 13:
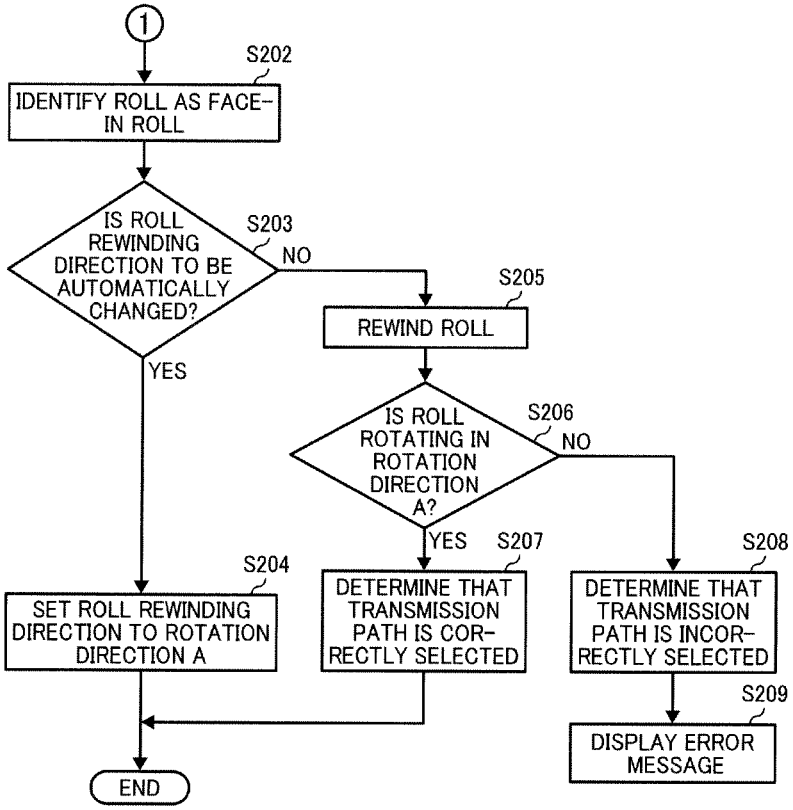
FIG. 13 is a flowchart illustrating the example of transmission path switching.

If the installed roll 4 corresponds to the face-in roll 4B, and if the roll rewinding direction is to be manually changed (NO at step S203), the drive motor 201 is driven to rotate the transport roller 22 in rotation direction B and rewind the print medium 2 into the roll 4 (step S205), as illustrated in FIG. 13. Then, whether or not the roll 4 is rotating in rotation direction A is determined from the detection result obtained by the rotary encoder 251 (step S206). In this rewinding operation, the roll 4 is rotated by a minimum amount enough to allow the identification of the rotation direction. If the roll 4 is rotating in rotation direction A (YES at step S206), it is determined that the transmission path for transmitting the drive force is correctly selected (step S207), and the present procedure as a preparation for printing is completed. If the roll 4 is rotating in rotation direction B (NO at step S206), it is determined that the transmission path for transmitting the drive force is incorrectly selected (step S208), and an error message is displayed to prompt changing of the roll rewinding direction (step S209).

In the above-described procedure, the roll rewinding direction changed by the manual operation is unascertained. Thus, the manually changed roll rewinding direction is identified by actually performing the operation of rewinding the print medium 2 into the roll 4. Alternatively, for example, a sensor or the like may be provided to the lever 240 illustrated in FIGS. 8A and 8B, and the information of the roll rewinding direction changed by the manual operation may be detected by the sensor or the like and retained in the image forming apparatus. In this case, whether to compete the procedure as a preparation for printing or display the error message may be determined on the basis of comparison between the information of the identified roll winding direction and the information of the roll rewinding direction retained in the image forming apparatus.

After the display of the error message and the manual change of the roll rewinding direction, a print job may be started, or the procedure in FIGS. 12 and 13 may be repeated to confirm that the transmission path has been successfully changed.

Figure 14A:
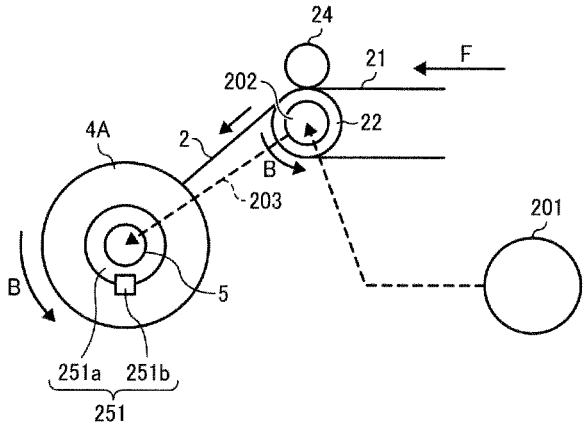
FIGS. 14A and 14B are schematic diagrams illustrating the relationship between the winding direction and the rotation direction of the roll in a medium rewinding operation in the embodiments of the present invention.
Figure 14B:
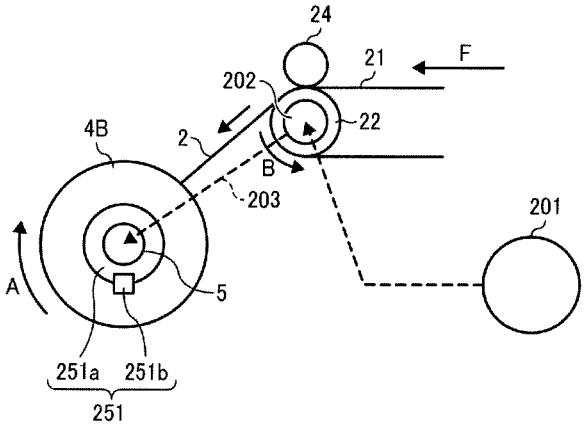

With reference to FIGS. 14A and 14B, description will be given of the relationship between the winding direction and the rotation direction of the roll 4 in the medium rewinding operation in the above-described embodiments. FIGS. 14 A and 14B illustrate, as an example, the configuration including the rotary encoder 251 provided to the spool 5.

FIG. 14A illustrates a configuration using the face-out roll 4A. In this case, when the transport roller 22 rotates in rotation direction B corresponding to the medium rewinding direction indicated by arrow F, the transmission path for transmitting the drive force is selected to rotate the roll 4A also in rotation direction B, to thereby rewind the print medium 2 into the roll 4 while applying the back tension to the print medium 2. FIG. 14B illustrates a configuration using the face-in roll 4B. In this case, when the transport roller 22 rotates in rotation direction B corresponding to the medium rewinding direction indicated by arrow F, the transmission path for transmitting the drive force is selected to rotate the roll 4B in rotation direction A, to thereby rewind the print medium 2 into the roll 4 while applying the back tension to the print medium 2.

According to the embodiments of the present invention, the back tension is applied to the print medium 2 during the medium rewinding operation irrespective of the winding direction of the roll 4.

The above-described embodiments use the linerless label sheet with no release liner attached thereto. The present invention, however, is similarly applicable to a rolled print medium having an adhesive surface with a release liner and a rolled sheet with no adhesive surface, for example. In the present specification, the term "image formation" refers to providing a medium with a meaningful image such as a character or a figure and also providing a medium with a meaningless image such as a pattern (i.e., simple ejection of liquid droplets onto a medium). Further, the term "ink" is not limited to so-called ink, and is used to collectively refer to various types of liquids with which the image formation is performed, such as recording liquid and fixing liquid. Further, the image forming apparatus includes both a serial-type image forming apparatus and a line-type image forming apparatus.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present invention may be practiced otherwise than as specifically described herein.

What is claimed is:

1. An image forming apparatus comprising:

a spool configured to hold a roll of print medium;

an image forming device configured to form an image on the print medium unwound from the roll;

a transporting device including a transport rotary member configured to transport the unwound print medium in a medium transporting direction to the image forming device to face the image forming device and a drive source configured to generate drive force for driving the transport rotary member to rotate; and a drive force transmission device provided between the transport rotary member and the spool, and configured to transmit the drive force to the spool when the transport rotary member rotates in a direction of rewinding the print medium into the roll, the drive force transmission device including:

a first gear train configured to form a first transmission path for transmitting the drive force to the spool to rotate the spool in a rotation direction the same as the rotation direction of the transport rotary member, and a second gear train configured to form a second transmission path for transmitting the drive force to the spool to rotate the spool in a rotation direction opposite to the rotation direction of the transport rotary member, wherein, the first transmission path is selected when the transport rotary member and the spool rotate in the same rotation direction during the transport of the print medium in the medium transporting direction by the transport rotary member, and the second transmission path is selected when the transport rotary member and the spool rotate in opposite rotation directions during the transport of the print medium in the medium transporting direction by the transport rotary member.

2. The image forming apparatus according to claim 1, wherein the print medium includes a printing surface and an adhesive surface with no release liner attached thereto.

3. The image forming apparatus according to claim 1, further comprising:

a rotation direction detector configured to detect the rotation direction of the spool when the print medium is transported; and a switching device configured to select either the first transmission path or the second transmission path in accordance with a detection result of the rotation direction detector by switching to the first transmission path when the rotation direction of the spool detected by the rotation direction detector is the same as the rotation direction of the transport rotary member and switching to the second transmission path when the rotation direction of the spool detected by the rotation direction detector is opposite to the rotation direction of the transport rotary member.

4. The image forming apparatus according to claim 3, wherein the spool includes a shaft configured to hold the spool, and the rotation direction detector is provided to the shaft of the spool.

5. The image forming apparatus according to claim 3, further comprising a rotary member configured to rotate in accordance with the rotation of the spool, wherein the rotation direction detector is provided to the rotary member.

* * * * *